United States Patent [19]

Ochs et al.

[11] 4,299,328

[45] Nov. 10, 1981

[54] TAMPERPROOF BOTTLE CLOSURE CAP

[75] Inventors: Charles S. Ochs, Lancaster; Carl E. Koontz, Thornville, both of Ohio

[73] Assignee: Anchor Hocking Corporation, Lancaster, Ohio

[21] Appl. No.: 134,173

[22] Filed: Mar. 26, 1980

[51] Int. Cl.[3] ..... B65D 49/12; B65D 41/34

[52] U.S. Cl. ..... 215/252; 215/253; 215/258

[58] Field of Search ..... 215/252, 253, 258, DIG. 1

[56] References Cited

U.S. PATENT DOCUMENTS 4,089,463 5/1978 Babiol ..... 215/DIG. 1

4,147,268 4/1980 Patel et al. ..... 215/258 X 4,225,050 9/1980 Reinhart ..... 215/252

*Primary Examiner*—George T. Hall

*Attorney, Agent, or Firm*—Holland, Armstrong, Wilkie & Previto

[57] ABSTRACT

A tamperproof closure is described for sealing containers such as soda, liquor or other bottles. The closure is a unitary molded closure cap which includes a tamper indicating band. The indicating band is applied with the closure cap and is locked onto a bead on the container so that it is torn free from the upper sealing portion of the cap as soon as an attempt is made to turn the closure cap off of the container.

17 Claims, 15 Drawing Figures

Fig. 1.
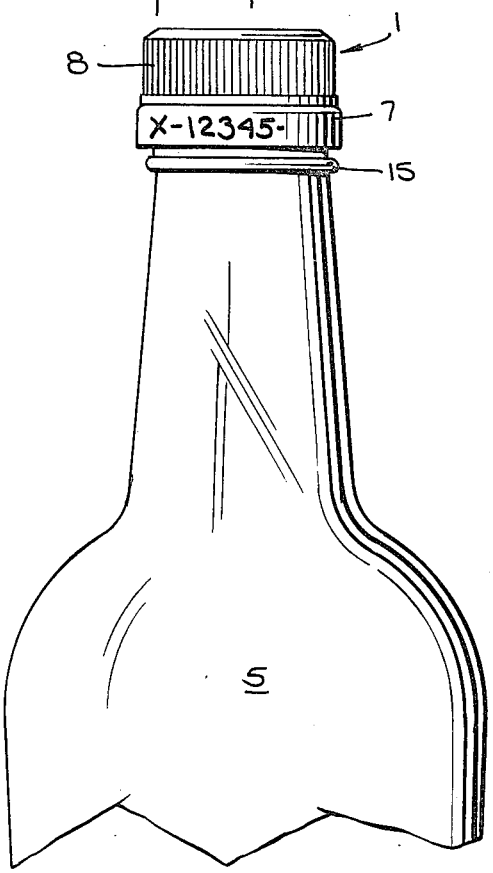
Fig. 2.
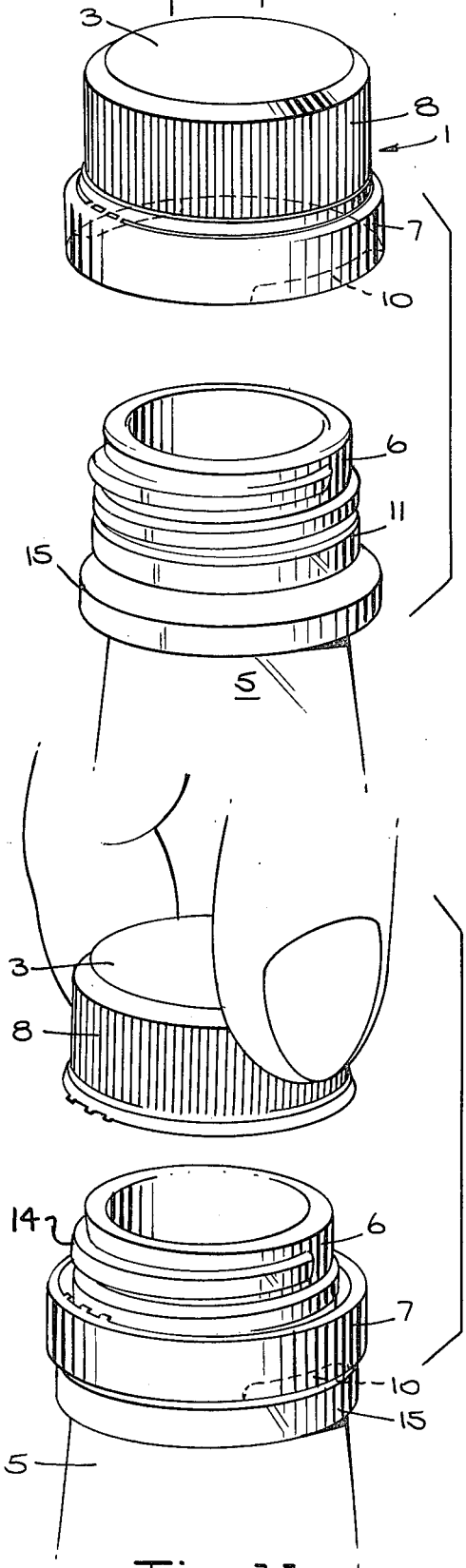
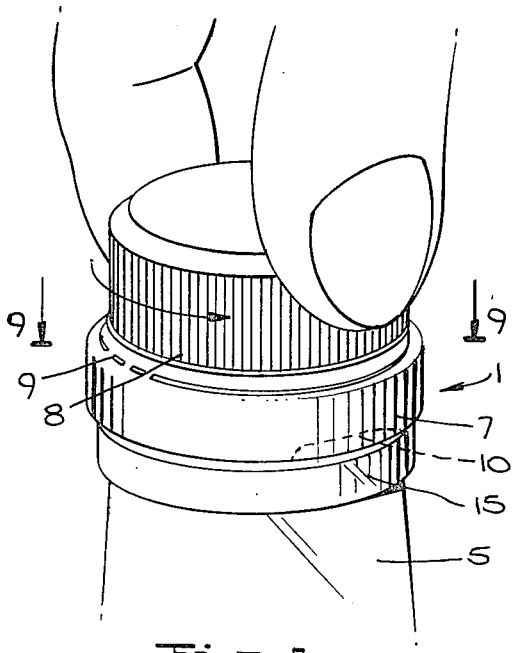
Fig. 8.
Fig. 11.

TAMPERPROOF BOTTLE CLOSURE CAP

BACKGROUND OF THE INVENTION

This invention relates to a twist-off closure cap for bottles such as beverage or liquor bottles and more particularly to a molded unitary plastic closure cap for bottles having an integral tamper indicating means. More particularly, the application relates to a molded closure bottle cap having a tamper indicating band which is applied with the cap during the normal bottle sealing operation and which prevents the removal of the cap without a clear indication of an attempt to remove the cap.

There are a number of well-known bottle caps which are being used for sealing beverage bottles. These known closure caps have tamper indicating means which provide an indication that an attempt has been made to turn the caps off of the sealed bottles. One particularly well known cap of this general type is an aluminum cap which has a sealing portion and a detachable tamper indicating ring. The application of the tamper indicating ring requires a separate shaping operation during cap application to shape the tamper indicating ring around a bead on the bottle finish.

The closure cap of the present invention provides an inexpensive unitary molded plastic cap which provides the tamper indicating functions of the above described metal cap. It includes a sealing cap portion and a tamper indicating band or ring. The cap is applied by means of high speed automatic bottle sealing machinery in a sealing operation which both seals the bottle with the sealing cap and which simultaneously applies the tamper indicating band without reshaping operations.

The band is applied so that it is locked onto the bottle finish and so that any attempt to turn off the sealing portion of the cap is clearly indicated by a severing of the band from the cap sealing portion.

A unique property of the tamper indicating band portion of the cap is an increased bottle retention grip of the tamper indicating ring onto the bottle finish as the cap removal force is increased. This feature of the cap provides for a positive tamper indication regardless of the efforts which may be made during an unauthorized removal of the bottle closure cap to remove the cap without severing the indicating band.

Accordingly, an object of the present invention is to provide an improved unitary molded plastic tamper indicating closure cap.

Another object of the present invention is to provide a unitary molded plastic tamperproof closure cap where the tamper indicating band retention force is increased during cap removal.

Another object of the present invention is to provide an improved unitary molded linerless tamperproof beverage cap.

Another object of the present invention is to provide an improved screw-on and twist-off beverage cap with tamper indicating means.

Another object of the present invention is to provide a unitary molded tamper indicating closure cap with an improved tamper indicating band.

Another object of the present invention is to provide an improved unitary plastic tamperproof beverage cap which may be applied using existing bottle sealing machinery.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 1 is an elevational view of a bottle sealed with a closure cap in accordance with the present invention.

FIG. 2 is an exploded perspective view of the closure cap of the invention and the bottle being sealed.

FIGS. 3, 4 and 5 are vertical sectional views illustrating a closure cap in accordance with the present invention.

FIG. 11 is a perspective view corresponding to FIG. 10.

DESCRIPTION OF THE PREFERRED EMBODIMENT

Figure 3:
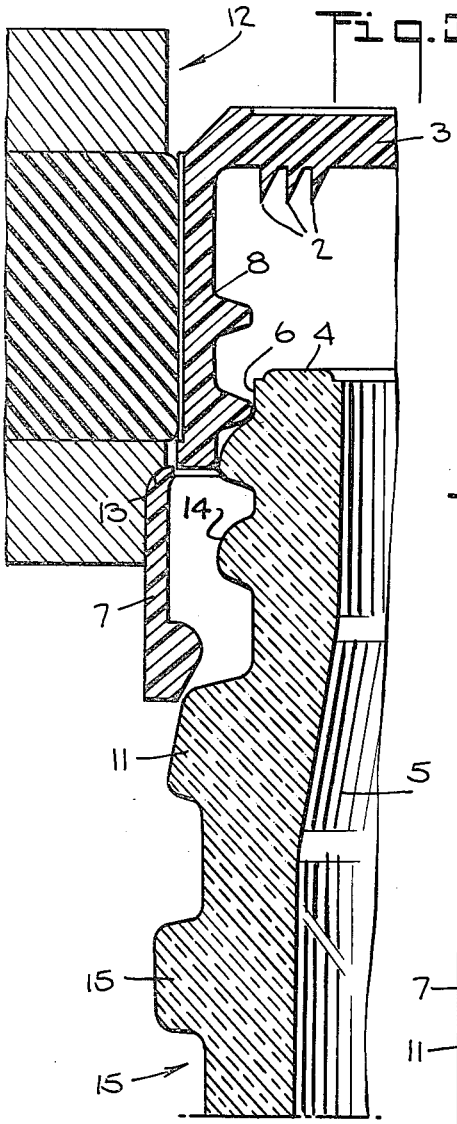

This invention relates to a unitary molded plastic closure cap which is applied to fill bottles by high speed automatic sealing machines and which when thus applied provides for a tamperproof seal. A tamperproof seal is a container seal where an unauthorized attempt to open the package results in an automatic indication that the unauthorized opening attempt has been made. For example, one known tamperproof closure provides for a tamper indication by means of a tamperproofing band or ring which is separated from the remainder of the closure when the unauthorized attempt is made.

Prior tamperproof closures of this general type include metal closure caps such as aluminum caps where there is a cuplike sealing portion of the cap and a temporarily attached tamper indicating ring. These prior caps are applied to the filled bottles with complicated automatic machinery which applies the caps and which then crimps or otherwise deforms the metal cap shell to interlock the tamper indicating band.

The present invention substitutes a unitary molded plastic cap for the metal closure and provides for both the sealing cup-like cap portion and a unitary tamperproof or tamper indicating band.

One characteristic of the metal caps is their ability to be applied to filled containers on high speed automatic sealing machinery. The closure cap of the present invention also has this advantage and provides for a high speed and low cost sealing machine application while at the same time providing a simple low cost plastic unitary closure cap.

The closure cap 1 illustrated in FIGS. 1 through 11 includes a linerless sealing means such as a series of concentric sealing rings 2 on the underside of the cap cover 3 for forming a tight seal between the cap 1 and the upper surface 4 of the bottle 5 finish 6.

Figure 7:
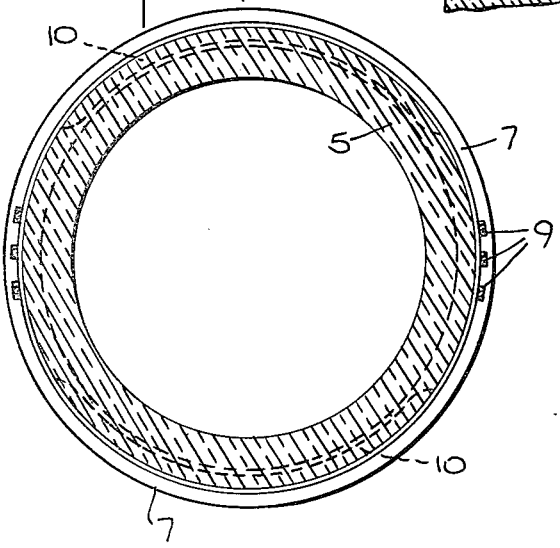
FIG. 7 is a horizontal sectional view taken along line 7—7 on FIG. 5.
Figure 9:
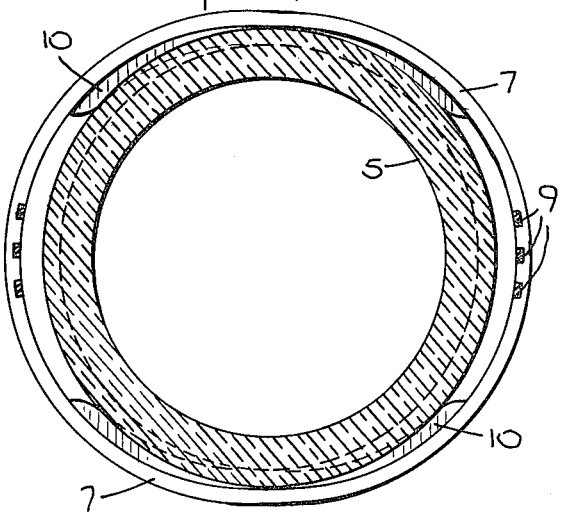
FIG. 9 is a horizontal sectional view taken along line 9—9 on FIG. 8 illustrating the increased engagement of the bottle gripping lugs on the band with a bead on the container finish during cap removal.

A tamperproofing band 7 is attached to the lower edge of the cap skirt 8 by a number of relatively thin and rupturable bridges 9. For reasons which will be more fully described below, the bridges 9 are located on diammetrically positioned portions of the band 7 and are spaced from the bottle gripping lugs 10 on the band 7. Thus, groups of several bridges 9 are spaced approximately 180° apart from each other, as best illustrated in FIGS. 7 and 9 of the drawings. The bridges 9 hold the tamper indicating band 7 onto the sealing portion of the closure 1 during cap application and sealing until the bottle is opened for use and while remaining unruptured indicate that the cap seal has not been tampered with.

Figure 4:
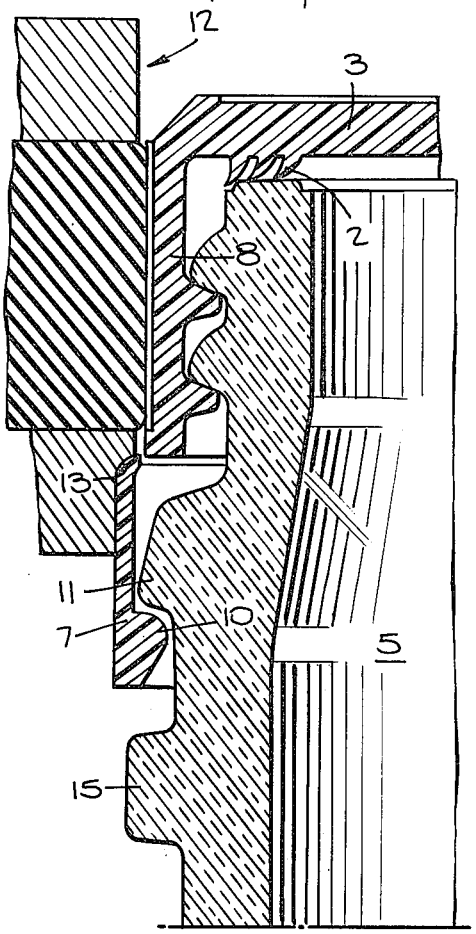
Figure 6:
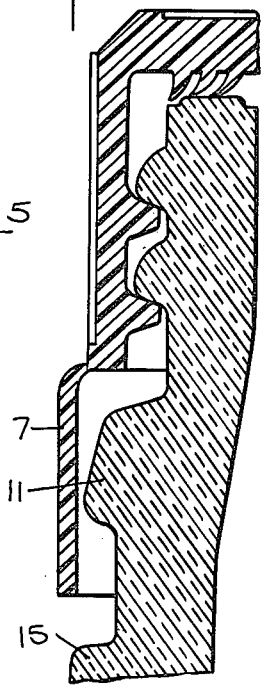
FIG. 6 is a vertical sectional view of a sealed bottle taken along line 6—6 of FIG. 5.

The tamperproofing band includes a pair of bottle engaging lugs 10 which are forced over and snapped under a cooperating bead 11 on the bottle 5 in the manner best illustrated in FIGS. 3, 4 and 5. During the application of the closure cap 1 to the bottle 5, a cooperating ring-like chuck 12 is preferably employed with the closure 1 to assure the downward movement of the tamper indicating band 7 over the bottle bead 11 during the sealing. The band engaging surface 13 of the chuck 12 prevents a premature rupture of the band bridges 9 during the bottle sealing operation.

The bottle engaging lugs 10 on the tamper indicating band 7 comprise a pair of lugs each of whose center is spaced about 90° from the attaching bridges 9. Two of these lugs 10 are provided in combination with the above described pair of groups of band attaching bridges 9. This particular arrangement of bridges 9 and lugs 10 provides for an improved tamper indicating action which will now be described in greater detail with particular reference to FIGS. 7 through 11.

Figure 8:
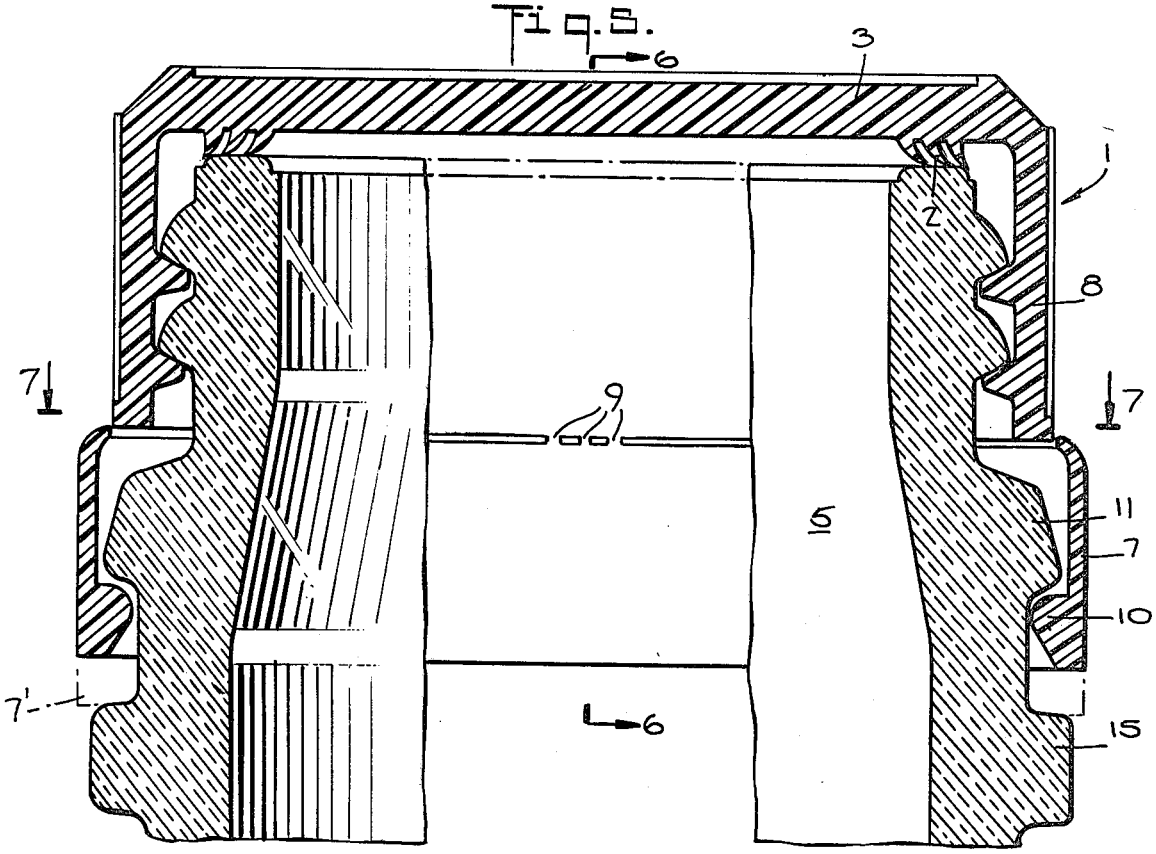
FIG. 8 is a perspective view illustrating a sealed bottle at the initial stage of cap removal.
Figure 10:
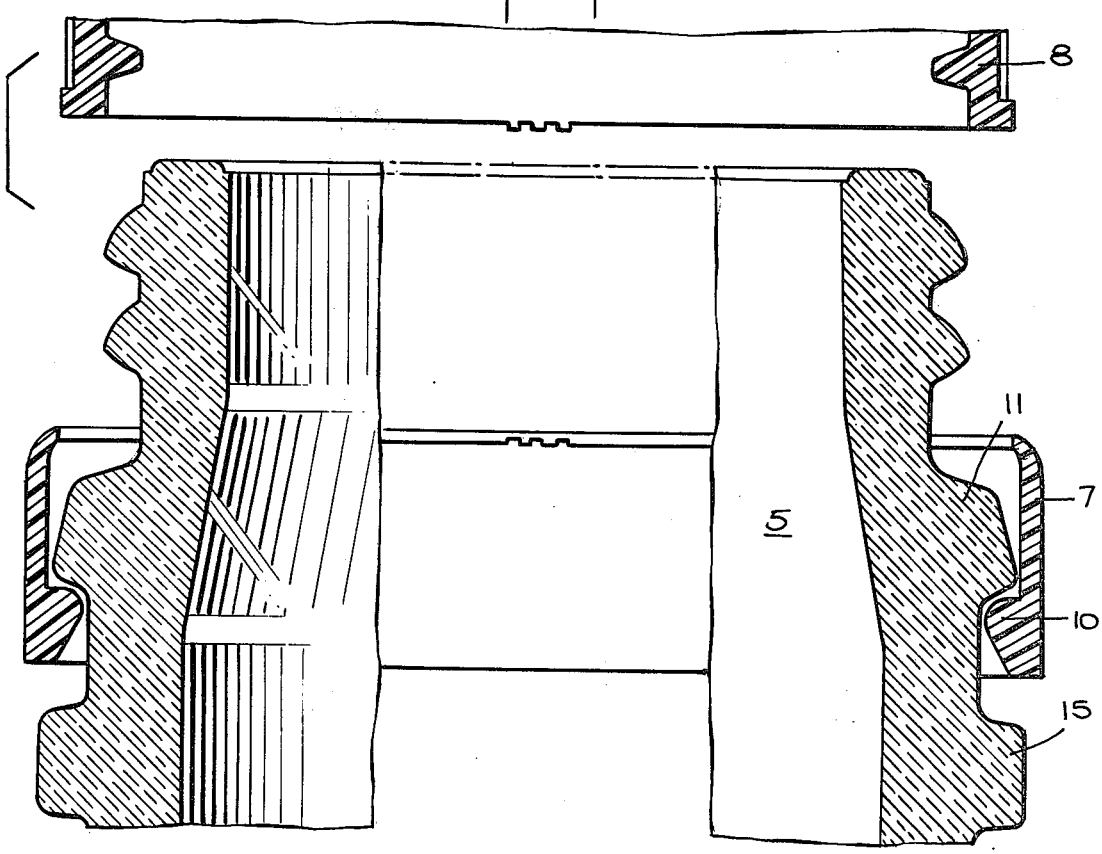
FIG. 10 is a vertical sectional view illustrating the removal of the cap from the bottle.
Figure 12:
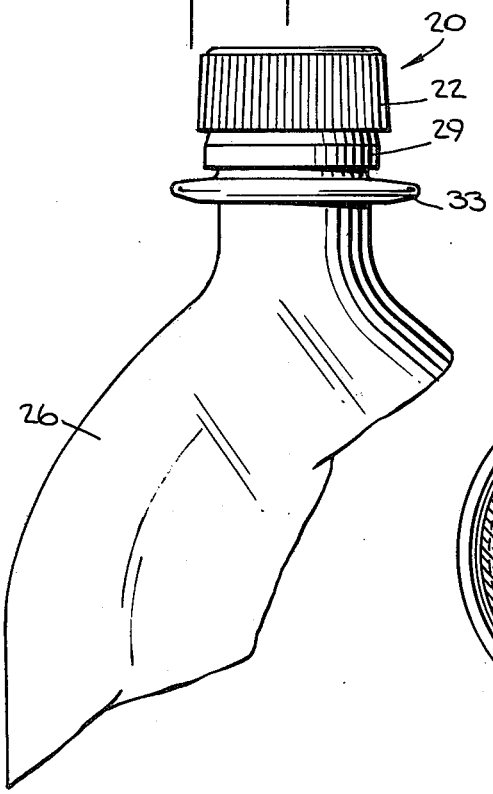
FIG. 12 is a side elevational view of another embodiment of the closure cap sealing the beverage bottle under pressure.
Figure 14:
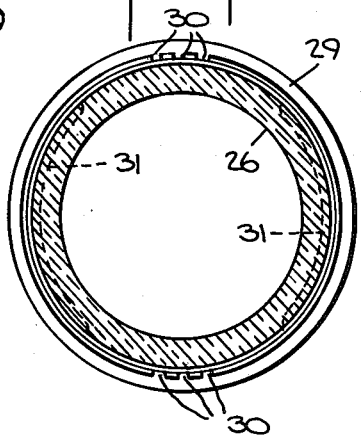
FIG. 14 is a horizontal sectional view of the sealed bottle of FIG. 12 taken along line 14—14 on FIG. 13.
Figure 15:
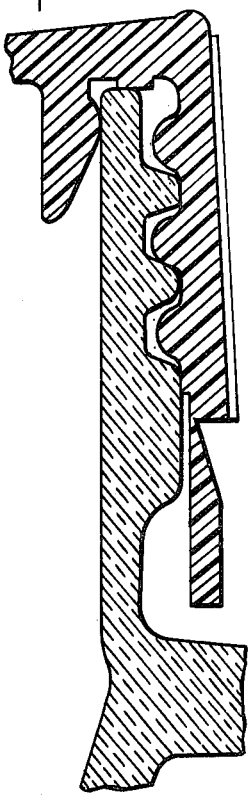
FIG. 15 is a vertical sectional view taken along line 15—15 on FIG. 13.
Figure 13:
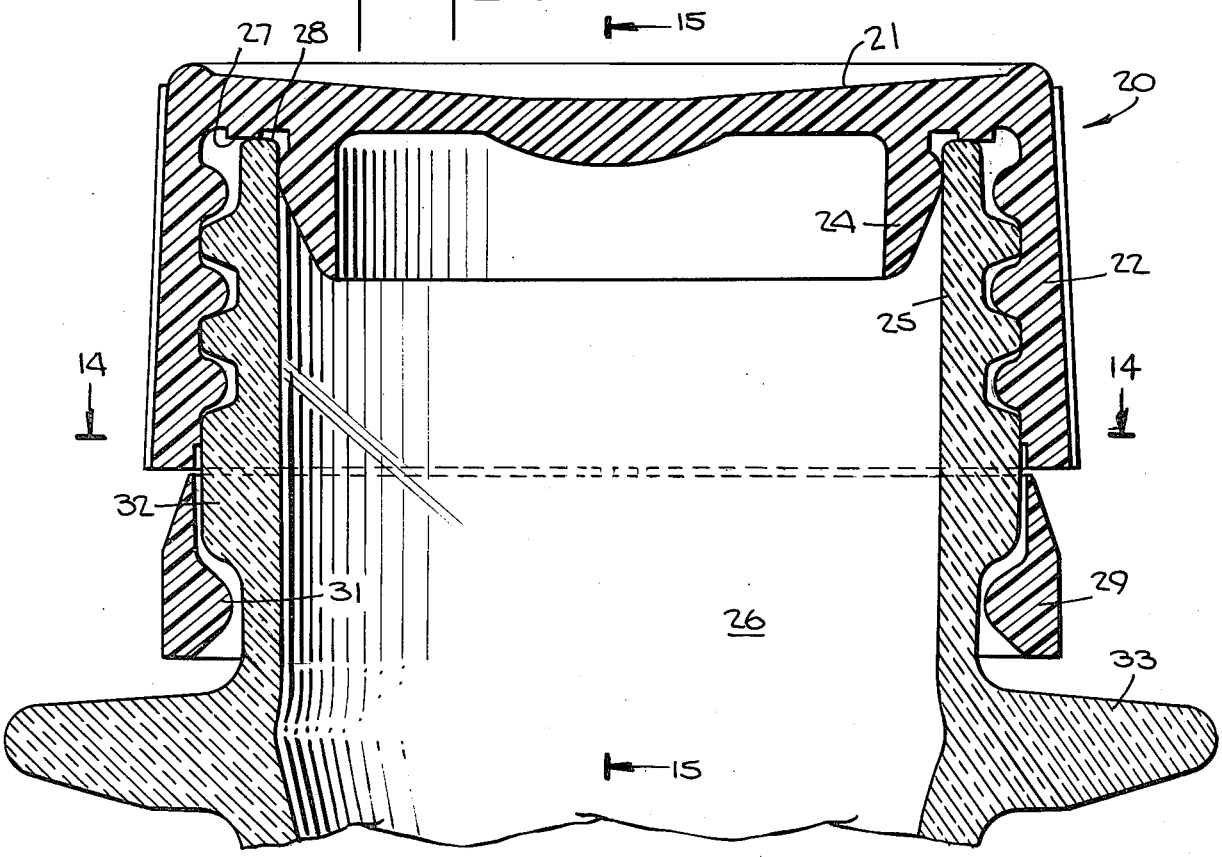
FIG. 13 is a vertical sectional view of the sealed bottle of FIG. 12.

When the cap 1 is removed as illustrated in FIG. 8, it is twisted upwardly on the bottle threads 14 causing a corresponding upward lifting force on the band bridges 9. As best illustrated in FIG. 9, this upward force causes a stretching action on the band 7 which results in the band 7 assuming an oval or elongated shape with the lugs 10 being pulled diammetrically inwardly and under the bottle bead 11 and with the bridges 9 moving outwardly. The greater the upward force at the bridges 9, the more pronounced is this additional lug 10 locking action. This assures the retention of the band 7 on the bottle 5 with the lugs 10 remaining beneath the bead 11 until the bridges 9 rupture permitting the cap 1 to be removed from the bottle 5 finish. The bead 15 is positioned slightly below the lower edge of the band 7. During the above described cap removal, the additional bead 15 prevents an axially downward distortion of the band 7 as the band 7 is limited to the dash-dot position 7' illustrated in FIG. 5. This further confinement of the band 7 during cap removal further assures band 7 retention and indication during cap removal. Other members of bridges and lugs may be used, for example, one of each or three of each, etc.

FIGS. 12 through 15 illustrate another embodiment of a closure cap comprising a cap 20 having the same general features and functions but being particularly adapted for use on a well known beverage bottle finish such as a finish used on plastic bottles. The cap 20 has similar cover 21 and skirt 22 portions with a linerless pressure sealing means provided on the underside of the cap cover 21. The pressure seal includes a circular sealing plug 24 engaging the interior 25 of the bottle 26 mouth and a circular rib 27 engaging the top surface 28 of the bottle finish 26. In this embodiment, a tamper indicating band 29 is attached by diammetrically spaced bridges 30 and a pair of lugs 31 are provided in the position illustrated in FIG. 14.

This circumferential displacement of the bridges 30 and the lugs 31 provides the above described band retention action during cap removal. The band 29 is positioned underneath the cap skirt 22 in the manner illustrated in FIGS. 13 and 15. This position protects the band 29 against unintentional removal during cap application as the lugs 31 on the band 29 snap downwardly over the retaining bead 32 on the bottle 26 finish. A second spaced bead or flange 33 may be provided on the finish to provide the band 29 restraining action in the manner described above in connection with the bead 15 on the bottle 5.

On FIG. 1, a legend is illustrated on the tamper indicating band 7. Under new regulations, such a legend may be used to replace the presently used Federal Government tax stamp. This indication on an individual package will indicate that the necessary Government regulations have been complied with and the necessary code will be included thereon. Such a legend may be applied by methods which emboss the band or it may be applied using available band printing techniques. A particularly advantageous method is a legend application using a laser beam instrument or a heated embossing technique. The band of the invention is particularly advantageous in this connection as it meets with requirements which call for the retention of the band on the container after it has been opened. As described with some detail, above, the band 7 of this invention remains on the container after the sealing closure cap has been removed.

It will be seen that an improved unitary tamperproof closure cap has been described which is readily manufactured and which may be applied using existing high speed bottle sealing machinery. The tamperproofing band has a novel lug and bridge construction which assures the retention of the band on a bottle making the tamper indication a positive and reliable one.

As various changes may be made in the form, construction and arrangement of the parts herein without sacrificing any of its advantages, it is to be understood that all matter herein is to be interpreted as illustrative and not in a limiting sense.

Having thus described our invention, we claim:

1. A unitary molded plastic closure cap for sealing a container having a threaded neck and a bead below said threads comprising the combination of:

a cover and a depending threaded skirt;

a sealing means;

a circular tamper indicating band releasably attached to the bottom of the skirt by spaced frangible bridge means; and lug means on said band for engaging said bead during cap removal;

said lug means and said frangible bridge means being circumferentially spaced from one another for providing reduced attachment between said tamper indicating band and said skirt directly above the lug means compared to the attachment provided elesewhere between said band and said skirt.

2. The closure cap as claimed in claim 1 in which said bridge means comprises one or more bridges and said lug means comprises one or more lugs spaced from said bridges.

3. The closure cap as claimed in claim 2 in which said bridge means comprises two bridges diammetrically spaced from one another and said lug means comprises two lugs each spaced about half way between said bridges and diammetrically from one another.

4. The closure cap as claimed in claim 1 which further comprises said band being spaced radially outwardly of said skirt.

5. The closure cap as claimed in claim 1 which further comprises said band being positioned beneath said skirt.

6. The closure cap as claimed in claim 5 in which said band has a circular tool engaging surface at its top.

7. The closure cap as claimed in claim 1 in which said sealing means comprises an integral plastic linerless sealing means.

8. The closure cap as claimed in claim 7 in which said sealing means comprises a plurality of sealing ribs on the underside of the cap cover.

9. The closure cap as claimed in claim 7 in which said sealing means comprises a circular plug positioned on the underside of the cap cover for engaging the container mouth.

10. The closure cap as claimed in claim 8 in which said ribs have a generally triangular cross-section.

11. A sealed package comprising the combination of:

a container having a threaded neck and a bead below said threads;

a cap having a cover and a depending threaded skirt engaging the container threads;

a sealing means on said cap;

a circular tamper indicating band releasably attached to the bottom of the skirt by spaced frangible bridges;

lug means on said band for engaging said container bead during cap removal; and said lug means and said frangible bridge means being circumferentially spaced from one another for providing reduced attachment between said tamper indicating band and said skirt directly above said lug means compared to the attachment provided elsewhere between said band and said skirt.

12. The sealed package as claimed in claim 11 in which siad bridges comprise a pair of bridges spaced diammetrically from one another on said band, and said lug means comprises a pair of lugs spaced diametrically from one another and positioned intermediate to said pair of bridges.

13. The sealed package as claimed in claim 11 in which said bridges comprise two groups of bridges with the groups being spaced diammetrically from one another.

14. The sealed package as claimed in claim 13 in which said lug means comprises two lugs each spaced about half way between said groups of bridges and diammetrically from one another.

15. The sealed package as claimed in claim 11 which further comprises said band being spaced radially outwardly of said skirt.

16. The sealed package as claimed in claim 11 which further comprises said band being positioned beneath said skirt.

17. The sealed package as claimed in claim 11 in which said container has a second bead positioned below and spaced from said first named bead and below said band.

* * * * *